US007325801B2

(12) United States Patent
Marra, III et al.

(10) Patent No.: US 7,325,801 B2
(45) Date of Patent: Feb. 5, 2008

(54) METHOD AND APPARATUS FOR DETECTING AN ABSENCE OF PRINT MEDIA

(75) Inventors: Michael A. Marra, III, Lexington, KY (US); Barry B. Stout, Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 303 days.

(21) Appl. No.: 10/867,439

(22) Filed: Jun. 14, 2004

(65) Prior Publication Data

US 2005/0275151 A1 Dec. 15, 2005

(51) Int. Cl.
*B65H 7/08* (2006.01)

(52) U.S. Cl. ..... 271/110

(58) Field of Classification Search ..... 271/110, 271/111, 114, 113, 117, 258.01
See application file for complete search history.

(56) References Cited

U.S. PATENT DOCUMENTS

| | | | | |
|---|---|---|---|---|
| 4,585,221 | A | 4/1986 | Lillibridge | |
| 4,928,949 | A | 5/1990 | Ramsey et al. | |
| 5,236,348 | A | 8/1993 | Fetherolf et al. | |
| 5,476,255 | A | 12/1995 | Murcko et al. | |
| 5,480,131 | A | 1/1996 | Furukawa et al. | |
| 5,507,478 | A | 4/1996 | Nottingham et al. | |
| 5,527,026 | A | 6/1996 | Padget et al. | |
| 5,547,181 | A | 8/1996 | Underwood | |
| 5,552,859 | A * | 9/1996 | Nakagawa et al. | 399/23 |
| 5,622,364 | A | 4/1997 | Dutton et al. | |
| 5,629,672 | A | 5/1997 | Brown et al. | |
| 5,651,538 | A | 7/1997 | Chung et al. | |
| 6,000,871 | A | 12/1999 | Fisher, Sr. | |
| 6,152,631 | A | 11/2000 | Park | |
| 6,206,362 | B1 | 3/2001 | Tan et al. | |
| 6,217,018 | B1 | 4/2001 | Tay et al. | |
| 6,364,556 | B1 | 4/2002 | Barbera et al. | |
| 6,446,954 | B1 | 9/2002 | Lim et al. | |

* cited by examiner

*Primary Examiner*—Patrick Mackey
*Assistant Examiner*—Thomas Morrison
(74) *Attorney, Agent, or Firm*—Taylor & Aust, P.C.

(57) ABSTRACT

A method and apparatus for detecting the absence of print media in an imaging device, such as a printer. The printer includes a print mechanism, a media tray for supplying sheets of print media to the printer, and a pick mechanism for moving the sheets of print media from the media tray to the print mechanism. The pick mechanism includes a pick roller, a pick motor that rotates the pick roller, and a controller in communication with the pick motor. Rotating the pick roller when there are no sheets of print media in the media tray causes the pick motor to stall. The controller produces a signal when the motor stalls indicating to the user that the printer is out of print media. A rotational position encoder coupled to the pick mechanism and in communication with the controller can be used to provide pick motor stall detection.

4 Claims, 3 Drawing Sheets

METHOD AND APPARATUS FOR DETECTING AN ABSENCE OF PRINT MEDIA

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND OF THE INVENTION

Imaging devices, such as a desktop printer, print images sent to the printer from a user's computer or other network device, onto print media, such as paper. To facilitate the use of the printer, it is desirable for the printer to include some means for monitoring the amount of paper remaining in the printer to notify the user when the printer is out of paper. In some printers, the printer included a media sensor placed in the paper tray in communication with a microprocessor of the printer. When the media sensor detected that no paper remained in the tray, a signal was generated, alerting the user that the printer was out of paper. However, in some printer designs, placing a media sensor in the paper tray may not be feasible or desirable. Thus, it is desirable to provide an alternate method for detecting when the printer is out of print media.

SUMMARY OF THE INVENTION

The present invention provides a method of detecting when there is no print media present in a printer that includes a tray for supplying sheets of print media to the printer. The method includes providing a pick mechanism for moving print media from the tray into the printer. The pick mechanism includes a pick motor. The pick mechanism is rotated using the pick motor to move the print media out of the tray. The method further includes detecting a motor stall condition when there is no print media in the tray, and generating a signal in response to the motor stall condition.

In one embodiment, the signal is used to provide an indication to a user that the printer is out of media. In another embodiment, the pick mechanism includes a DC motor.

Further aspects of the present invention, together with the organization and operation thereof, will become apparent from the following detailed description of the invention when taken in conjunction with the accompanying drawings.

DETAILED DESCRIPTION

Figure 1:
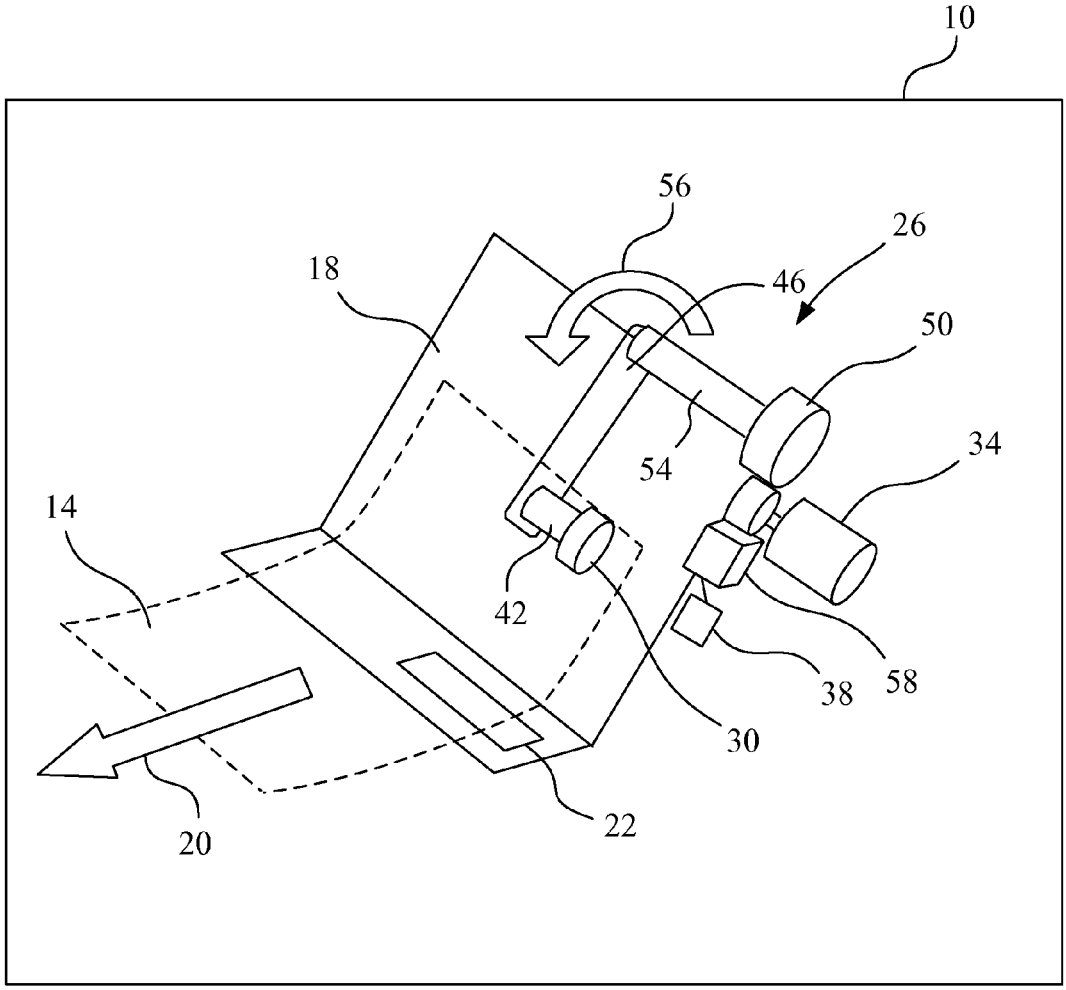
FIG. 1 is an illustration of one embodiment of a pick mechanism according to the present invention, illustrating an L-shape paper path.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. The order of limitations specified in any method claims does not imply that the steps or acts set forth therein must be performed in that order, unless an order is explicitly set forth in the specification.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and it should be noted that other alternative mechanical configurations are possible.

FIG. 1 illustrates an imaging device, such as a printer 10, that is capable of communication with a computer or a network. The printer 10 includes a print mechanism (not shown) for printing an image onto a sheet of print media, such as paper 14. The paper 14 is stored in the printer 10 in a media tray 18 until the paper is moved to the print mechanism for printing, such movement being in the direction of arrow 20. The media tray 18 includes a buckler 22 that helps hold the stack of papers in place in the media tray 18 and helps buckle the top sheet of paper with respect to the rest of the stack to ensure that only one sheet of paper is fed into the print mechanism at a time.

The printer 10 also includes a pick mechanism 26 for moving the paper 14 out of the media tray 18 and to the print mechanism. In the illustrated embodiment, the pick mechanism 26 defines a generally L-shaped paper path. The pick mechanism 26 includes a pick roller 30 in contact with the sheets of paper 14 in the media tray 18, a pick motor 34 that rotates the pick roller 30, and a controller 38 (illustrated schematically) in communication with the pick motor 34. In the illustrated embodiment, the pick motor 34 is a direct current motor, though in other embodiments, other types of motors, such as a stepper motor, can be used and still fall within the scope of the present invention.

The pick roller 30 rotates on a pick shaft 42 that is controlled by the motor 34. The pick mechanism 26 further includes an auto compensator mechanism 46 that pivots the pick roller 30 into the stack of paper 14 in the media tray 18. The auto compensator mechanism 46 rotates the pick shaft 42 and can increase the force of the pick roller 30 into the paper when more power is required to move a sheet of the paper 14 out of the tray 18 (such as when thick or heavy print media is present in the media tray 18). A gear train (not shown) inside the auto compensator mechanism 46 rotates the pick shaft 42, which in turn causes rotation of the pick roller 30.

The motor 34 is coupled to and rotates a motor gear train 50, which in turn rotates an upper shaft 54. The rotation of the gear train 50 and upper shaft 54 (in the direction of arrow 56) causes rotation of the gear train in the auto compensator mechanism 46. The rotation of the upper shaft 54 causes the auto compensator mechanism 46 to pivot into the paper, and causes rotation of the pick roller 30.

The pick mechanism 26 also includes a position encoder 58 in communication with the controller 38 and the motor 34. The position encoder 58 provides information on the rotation of the pick shaft 42 to the controller 38. The position encoder 58 can detect when the motor 34 stops. The pick shaft 42 will not rotate when the motor 34 stops.

The controller 38 in the illustrated embodiment includes a microprocessor that is programmed with firmware to compute a specified algorithm to compute motor voltage from measured data within the printer 10. The controller 38 processes data from the encoder 58 to provide adjustments to the motor 34, such as adjusting the voltage supplied to the motor 34, in order to control the pick mechanism 26.

Figure 2:
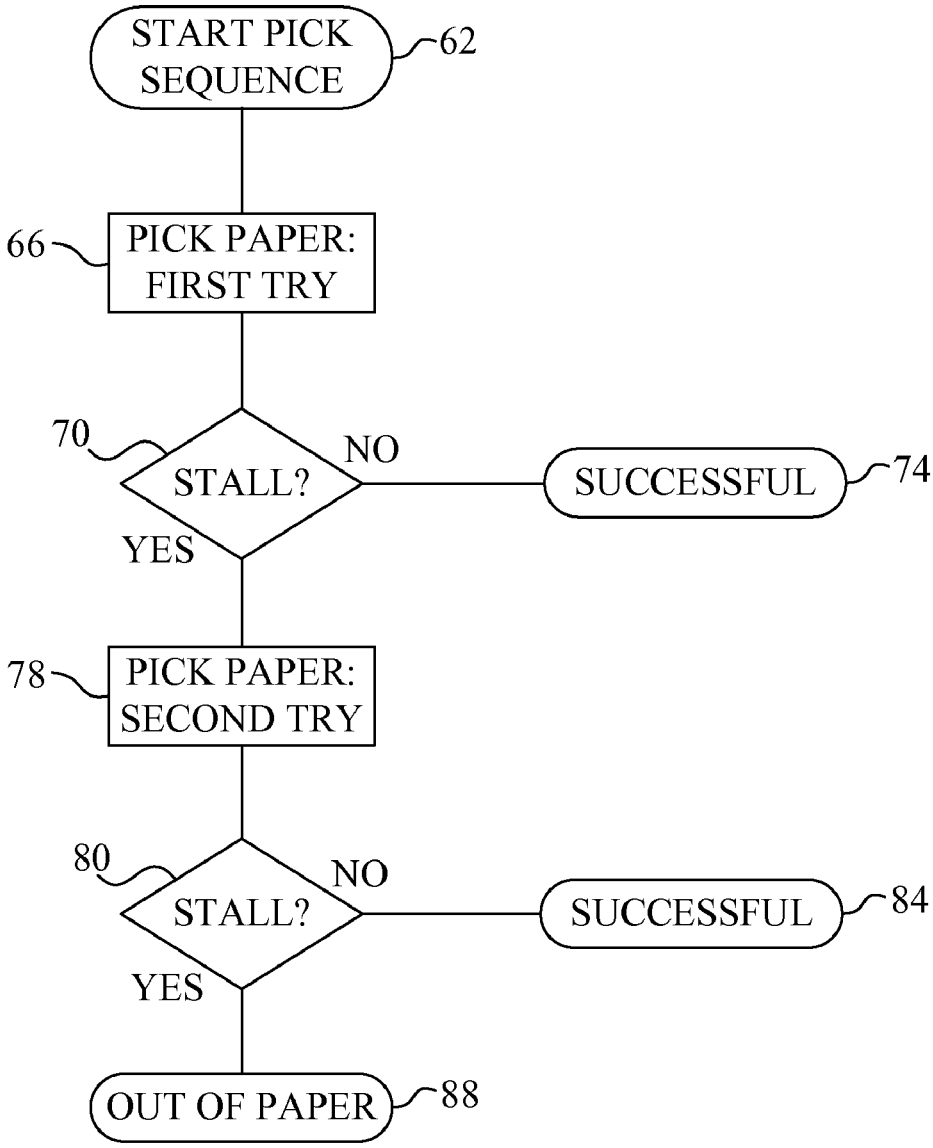
FIG. 2 is a flow diagram illustrating the steps of the method according to the invention.

The pick mechanism 26 described above can be used to perform a method of detecting when there is no print media present in the media tray 18. With reference to FIG. 2, a user sends a print command to the printer 10, which begins the pick sequence, as shown at step 62. The controller 38 sends a signal to the pick motor 34 to rotate the gear train 50, and thus the pick roller 30, as discussed above. In step 66, the pick mechanism 26 makes a first attempt to pick a sheet of paper 14 from the media tray 18 to move the paper 14 to the print mechanism. If there is paper 14 in the media tray 18, then the first attempt to pick is successful, as shown at step 74, and there is no motor stall.

If there is no paper or other print media in the media tray 18 at step 70, or if the first pick attempt was not powerful enough to move the print media out of the tray 18 to the print mechanism, then the pick mechanism 26 will lock up as the pick roller 30 attempts to rotate on the bottom of the tray 18. Generally, the pick mechanism 26 will attempt a low power pick first, which can handle most media types. The pick roller 30 will generally not slide or rotate on the surface of the tray 18 under the normal loads supplied by the auto compensator mechanism 46, locking up the pick roller 30. If the pick roller 30 cannot rotate, the pick shaft 42, the auto compensator mechanism 46, and the components back up the path to the motor 34 will not rotate, causing the motor 34 to stall. The controller 38 receives shaft rotation information from the position encoder 58 and detects the stall at step 70.

If a stall is detected at step 70, the controller 38 will direct the pick mechanism 26 to attempt a second pick at step 78. The controller 38 will change the amount of voltage available to the motor 34, thus increasing the power to the auto compensator mechanism 46, to make the second pick attempt more powerful. To do this and depending on the capacity of the printer power supply, some non-essential printer subsystems may need to be temporarily deactivated during the second pick attempt so that their power can be redirected to the pick mechanism 26. Increasing the power to the auto compensator mechanism 46 will increase the force with which the auto compensator mechanism 46 pivots the pick roller 30 into the stack of paper in the tray 18. If a sheet of paper 14 (or other print media) is delivered to the print mechanism after the second pick attempt, then the pick was successful, as shown at step 84, and no stall occurs.

On the other hand, if there is no paper in the media tray 18 at step 80, the pick roller 30, and thus the motor 34 will stall a second time. If the second stall is detected by the controller 38 (through the shaft rotation information from the position encoder 58), the controller 38 will determine that the printer is out of media and generate a signal indicating that no media remains in the printer 10 at step 88. The signal can trigger an indication to the user that the printer 10 is out of print media, such as by activating an error light on the printer, sending an error message to the user's computer or to an operator panel of the printer, or even activating an audible error message.

The above-described method provides a fast, user friendly indication that the printer is out of paper without requiring a sensor in the media tray 18 or requiring the addition of other complex or expensive components to the printer 10. In one embodiment, the first stall time was approximately 15 milliseconds, the second stall time was approximately 50 milliseconds, with a 100 millisecond pause between tries. Thus, the controller 38 detected an out of paper condition in a fraction of a second without requiring additional hardware in the printer, and without distracting the user.

Figure 3:
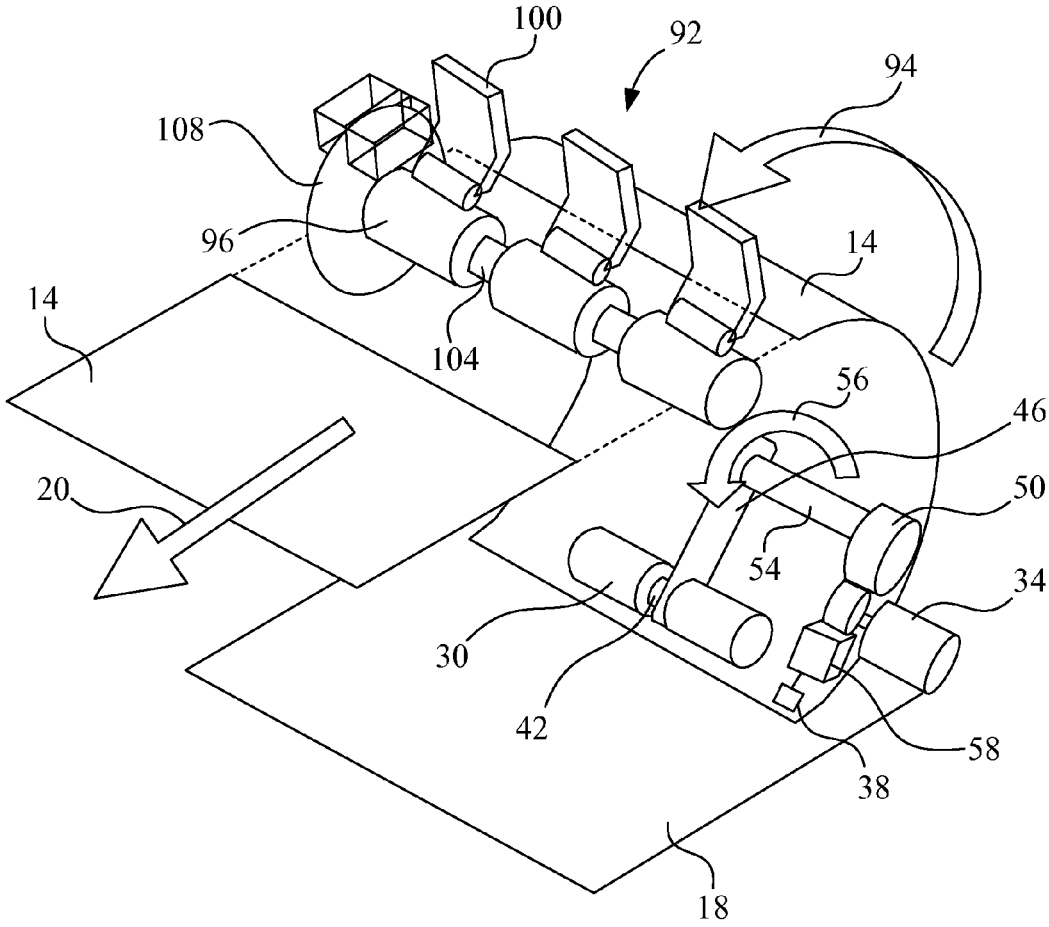
FIG. 3 is an illustration of another embodiment of a pick mechanism, illustrating a C-shape paper path.

FIG. 3 illustrates an alternate embodiment of a pick mechanism 92, having a generally C-shaped paper path. Like components of the pick mechanism 92 will be given like reference numerals to the corresponding components in pick mechanism 26 described above. The controller 38 receives information from the encoder 58 and controls the motor 34 (and thus the rotation of the pick roller 42) in the same way discussed above with respect to FIG. 1.

The rotation of the pick roller 42 moves the a sheet of paper 14 out of the media tray 18 in the direction of arrow 94 and between a feed roller 96 and a guide 100 as the paper 14 moves out of the pick mechanism 92. The feed roller 96 rotates on a feed roller shaft 104. A rotary index encoder 108 monitors the rotation of the feed roller shaft 104 and communicates the shaft rotation information to the controller 38. The feed roller 96 moves the paper 14 out of the pick mechanism 92 to the print mechanism in the direction of arrow 20. The pick mechanism 92 can be used to perform the method of detecting when there is no print media present in the media tray 18 as discussed above with respect to FIG. 2 and similar to the embodiment described with respect to FIG. 1. The pick mechanism 92 is designed to cause motor stall when there is no media in the media tray 18 with the stall being interpreted by the controller 38 as an out of media condition as previously described.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

The invention claimed is:

1. In a printer including a media tray for holding one or more sheets of media, a printing mechanism and a pick mechanism for moving a sheet of print media from the media tray to the printing mechanism with the pick mechanism including a controller and a pick motor, a method of monitoring the absence of print media present in the media tray comprising:

rotating the pick mechanism using the pick motor to move the sheet of print media from the media tray;

detecting a first pick motor stall condition using the controller;

rotating the pick mechanism again using the pick motor and increasing the power transmitted to the pick mechanism;

detecting a second pick motor stall condition using the controller; and generating a signal in response to the second motor stall condition, wherein the signal corresponds to a condition where the printer is out of print media.

2. The method of claim 1, further comprising providing an indication to a user that the printer is out of print media based on the signal.

3. The method of claim 2, wherein the indication is provided by at least one of an error light on the printer, an error message on an operator panel of the printer, an error message on a computer screen in communication with the printer, and an audible sound.

4. The method of claim 2, the pick mechanism further including a rotational position encoder coupled to the pick mechanism and in communication with the controller, wherein detecting the pick motor stall conditions comprises the controller using pick mechanism rotational position information from the position encoder.

* * * * *